US008872075B2

(12) United States Patent
Oh et al.

(10) Patent No.: US 8,872,075 B2
(45) Date of Patent: Oct. 28, 2014

(54) POSITIVE TEMPERATURE COEFFICIENT (PTC) ROD ASSEMBLY

(75) Inventors: Man Ju Oh, Ulsan (KR); Duck Chae Jun, Seongnam-si (KR); Tae Soo Sung, Asan-si (KR)

(73) Assignees: Hyundai Motor Company, Seoul (KR); Kia Motors Corporation, Seoul (KR); Modine Korea, LLC., Asan-Si (KR)

( * ) Notice: Subject to any disclaimer, the term of this patent is extended or adjusted under 35 U.S.C. 154(b) by 1088 days.

(21) Appl. No.: 12/510,159

(22) Filed: Jul. 27, 2009

(65) Prior Publication Data

US 2010/0140253 A1 Jun. 10, 2010

(30) Foreign Application Priority Data

Dec. 5, 2008 (KR) ..... 10-2008-0123101

(51) Int. Cl.
*H05B 3/00* (2006.01)

(52) U.S. Cl.
USPC ..... 219/504; 219/485; 219/483; 219/505

(58) Field of Classification Search
USPC ..... 219/485, 505, 520, 530, 536, 540, 219/544–548; 392/485; 388/306–309
See application file for complete search history.

(56) References Cited

U.S. PATENT DOCUMENTS

| | | | | |
|---|---|---|---|---|
| 3,584,189 | A | 6/1971 | Marcoux | |
| 5,471,034 | A * | 11/1995 | Kawate et al. | 219/485 |
| 5,756,215 | A * | 5/1998 | Sawamura et al. | 428/446 |
| 7,649,438 | B2 | 1/2010 | Ikeda et al. | |
| 2002/0053562 | A1 * | 5/2002 | Cuillery et al. | 219/254 |
| 2007/0018777 | A1 * | 1/2007 | Seock | 338/22 R |
| 2007/0045274 | A1 | 3/2007 | Lee | |
| 2007/0068927 | A1 | 3/2007 | Bohlender et al. | |
| 2008/0073336 | A1 | 3/2008 | Bohlender et al. | |
| 2009/0026191 | A1 | 1/2009 | Bohlender et al. | |

FOREIGN PATENT DOCUMENTS

| | | | |
|---|---|---|---|
| CN | 2094843 (U) | | 1/1992 |
| CN | 91208163.5 | | 1/1992 |
| CN | 101179899 | A | 5/2008 |
| EP | 0 300 132 | A1 | 1/1989 |
| JP | 4-258982 | A | 9/1992 |
| JP | 05-001195 | U | 1/1993 |
| JP | 05-343168 | A | 12/1993 |
| JP | 6-73655 | U | 10/1994 |
| JP | 7-77882 | A | 3/1995 |
| JP | 08-138836 | A | 5/1996 |

(Continued)

OTHER PUBLICATIONS

KR 10-083832 Patent Abstract Translation as provided by Applicant.*

*Primary Examiner* — Brian Jennison
(74) *Attorney, Agent, or Firm* — Morgan, Lewis & Bockius LLP

(57) ABSTRACT

A Positive Temperature Coefficient (PTC) assembly, in which protrusions are formed on opposite longitudinal edges of an electrode terminal, PTC elements are held between the protrusions and are in contact with the electrode terminal, an insulating member is attached to an outer surface of the electrode terminal, and a rod cover houses therein the electrode terminal, the PTC elements and the insulating member. A simple structure is realized, fabrication costs are reduced, and a hollow space inside the rod cover is minimized, leading to improved heat transfer efficiency from the PTC elements to the rod cover, reduced noise and a slim structure.

6 Claims, 4 Drawing Sheets

(56) References Cited

FOREIGN PATENT DOCUMENTS

| | | | |
|---|---|---|---|
| JP | 8-138836 | A | 5/1996 |
| JP | 9-204978 | A | 8/1997 |
| JP | 3091861 | U | 11/2002 |
| JP | 2007-103939 | A | 4/2007 |
| JP | 2007-147259 | A | 6/2007 |
| JP | 2008-71553 | A | 3/2008 |
| JP | 2008-84827 | A | 4/2008 |
| KR | 10-2005-0025368 | A | 3/2005 |
| KR | 10-2005-0097808 | A | 10/2005 |
| KR | 10-0688542 | B1 | 3/2007 |
| KR | 10-2007-0035729 | A | 4/2007 |
| KR | 10-2007-0045541 | A | 5/2007 |
| KR | 10-0720131 | B1 | 5/2007 |
| KR | 10-2007-0060272 | A | 6/2007 |
| KR | 10-0759580 | B1 | 9/2007 |
| KR | 10-0791665 | B1 | 1/2008 |
| KR | 10-0831832 | B1 | 5/2008 |
| KR | 10-0836852 | B1 | 6/2008 |

* cited by examiner

POSITIVE TEMPERATURE COEFFICIENT (PTC) ROD ASSEMBLY

CROSS-REFERENCE TO RELATED APPLICATION

The present application claims priority of Korean Patent Application Number 10-2008-123101 filed Dec. 5, 2008, the entire contents of which application is incorporated herein for all purposes by this reference.

BACKGROUND OF THE INVENTION

1. Field of the Invention

The present invention relates to a Positive Temperature Coefficient (PTC) assembly. More particularly, the present invention relates to a PTC assembly, in which protrusions are formed on opposite longitudinal edges of an electrode terminal, PTC elements are held between the protrusions and are in contact with the electrode terminal, an insulating member is attached to an outer surface of the electrode terminal, and a rod cover houses therein the electrode terminal, the PTC elements and the insulating member, such that a simple structure is realized, fabrication costs are reduced, and a hollow space inside the rod cover is minimized, leading to improved heat transfer efficiency from the PTC elements to the rod cover, reduced noise and a slim structure.

2. Description of Related Art

A vehicle is equipped with an air conditioning system for selectively supplying cold and warm air to the inside thereof. In the summer season, an air conditioner is actuated to supply the cold air. In the winter season, a heater is actuated to supply the warm air.

In general, the heater is based on a heating system in which coolant heated by circulation through an engine exchanges heat with air introduced by a fan, so that warmed air is supplied to the inside of the vehicle. This heating system has high energy efficiency because it uses the heat generated from the engine.

However, in the winter season, heating is not available immediately after the engine is started since it takes some time until the engine is heated after being started. As such, the engine often idles for a predetermined time prior to moving the vehicle until the coolant is heated to a temperature suitable for the heating. This idling of the engine causes energy waste and environmental pollution.

In order to prevent this problem, there has been used a method of heating the interior of the vehicle using a separate pre-heater for a predetermined time while the engine is being warmed up. A conventional heater using a heating coil effectively performs the heating due to high heat generation, but has problems such as high fire danger and frequent repair and replacement of parts due to short lifetime of the heating coil.

Thus, a heater using a Positive Temperature Coefficient (PTC) element has recently been developed. This PTC heater has low fire danger, and can guarantee semi-permanent use due to long lifetime.

FIG. 1 is a schematic exploded perspective view illustrating a conventional PTC pre-heater for a vehicle.

As illustrated in FIG. 1, a PTC pre-heater includes PTC rod assemblies 10 each having a PTC element, heat-radiating fin assemblies 20 disposed in parallel on opposite sides of the respective PTC rod assemblies 10, and cathode terminals 30 disposed in parallel between the heat-radiating fin assemblies 20. The PTC pre-heater also includes frames 40 and 50 mounted on opposite outer sides of the coupling block, in which the PTC rod assemblies 10, the heat-radiating fin assemblies 20 and the cathode terminals 30 are coupled to each other. In addition, the PTC pre-heater further includes housings 60 and 70 coupled to opposite longitudinal ends of a coupling block, in which the PTC rod assemblies 10, the heat-radiating fin assemblies 20, the cathode terminals 30 and the frames 40 and 50 are coupled to each other.

As illustrated in FIGS. 2 and 3, a lower rod cover 11 having therein a channel serves as a kind of a container. An insulator 12 is disposed on the bottom of the lower rod cover 11 so as to prevent a short circuit. The insulator 12 is made of a material such as nylon, which is electrically insulating but has good thermal conductivity.

An anode terminal 17 is fixedly coupled on the insulator 12 in a longitudinal direction, and is made of a metal such as carbon steel or aluminum. PTC elements 18 placed on the anode terminal 17 are fixedly coupled to the insulator 12 so as to generate heat when electric power is supplied thereto. Further, an upper rod cover 19 placed on the PTC elements 18 is coupled with the lower rod cover 11. Electric current flows to each cathode terminal 30 through the upper and lower rod covers 11 and 19.

However, a PTC rod assembly having this construction has problems in that many parts are necessarily assembled because the insulator 12 are separately required, in that each part has a complicated shape, making an assembling process difficult, and in that the thickness thereof is increased. Thus, an insulating effect is increased to degrade heat transfer efficiency. Further, the lower rod cover 11 is not in direct contact with the PTC elements 18 from the structural point of view, and air exists between the parts, so that the heat transfer efficiency of the PTC elements is lowered. Due to expansion of internal air caused by heating, the parts are separated from each other, so that the air leaks out when the pre-heater is initially driven, thereby causing noise and lowering performance.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention provide a Positive Temperature Coefficient (PTC) assembly, in which protrusions are formed on opposite longitudinal edges of an electrode terminal, PTC elements are held between the protrusions and are in contact with the electrode terminal, an insulating member may be attached to an outer surface of the electrode terminal, and a rod cover houses therein the electrode terminal, the PTC elements and the insulating member, such that a simple structure may be realized, fabrication costs are reduced, and a hollow space inside the rod cover may be minimized, leading to improved heat transfer efficiency from the PTC elements to the rod cover, reduced noise and a slim structure.

In various embodiments of the invention, the PTC rod assembly may include a PTC element generating heat when electric power may be supplied thereto; an electrode terminal configured as a flat plate with at an upper surface thereof contacting a lower surface of the PTC element, wherein the electrode terminal has protrusions at opposite longitudinal edges thereof to contact opposite lateral sides of the PTC element, thereby holding the positive temperature coefficient element between the protrusions; an insulating member attached to a lower surface of the electrode terminal and outer surfaces of the protrusions, which are not in contact with the PTC element; and a rod cover housing therein the PTC element, electrode terminal and insulating member. An upper surface of the PTC element and outer surfaces of the insulating member are fixedly contacted with inner surfaces of the rod cover.

According to various embodiments of the present invention, the protrusions are formed on the opposite longitudinal edges of the electrode terminal, the PTC element may be held between the protrusions and are in contact with the electrode terminal, the insulating member may be attached to the outer surface of the electrode terminal, and the rod cover houses therein the electrode terminal, the PTC element and the insulating member, such that a simple structure may be realized, fabrication costs are reduced, and a hollow space inside the rod cover may be minimized, leading to an improved heat transfer efficiency from the PTC element to the rod cover, reduced noise and a slim structure.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
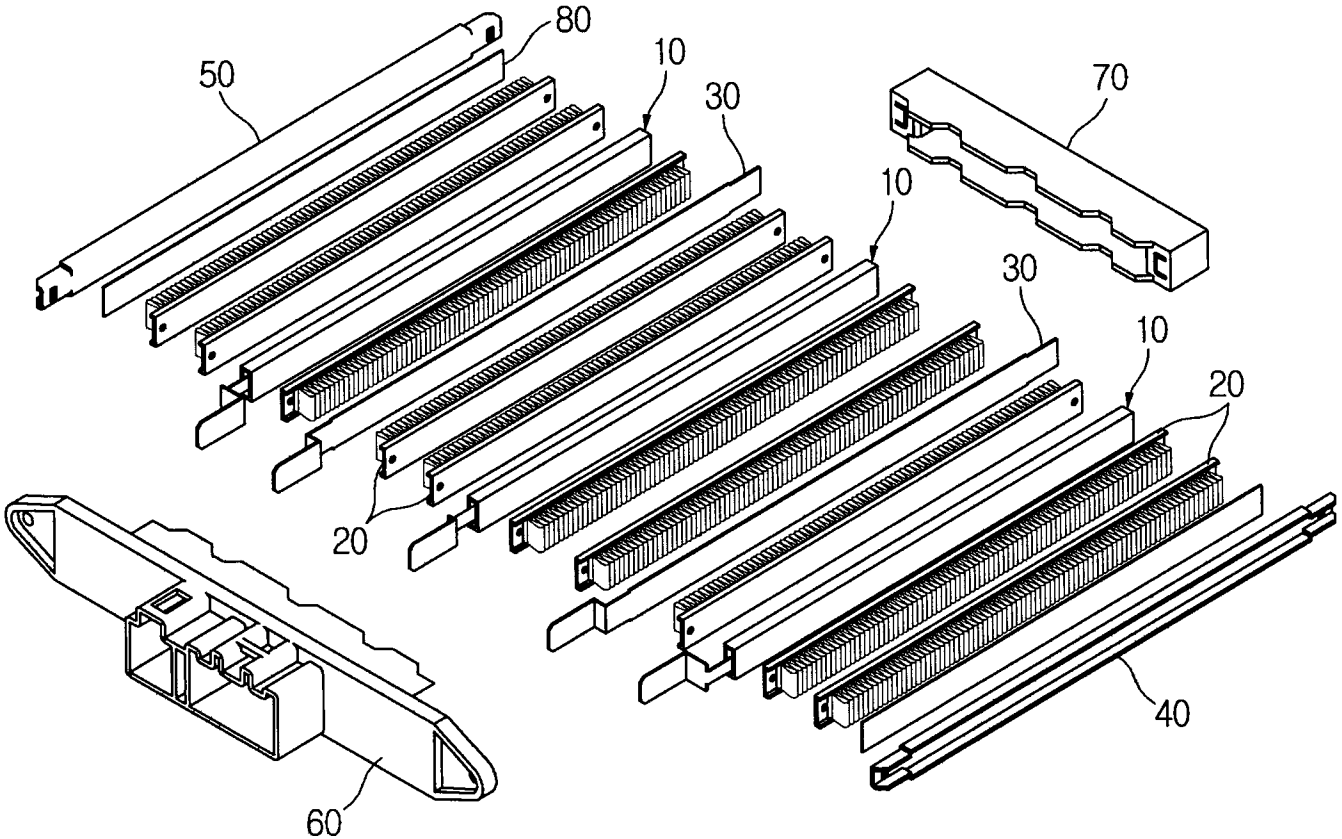
FIG. 1 is a schematic exploded perspective view illustrating an exemplary PTC pre-heater for a vehicle.
Figure 2:
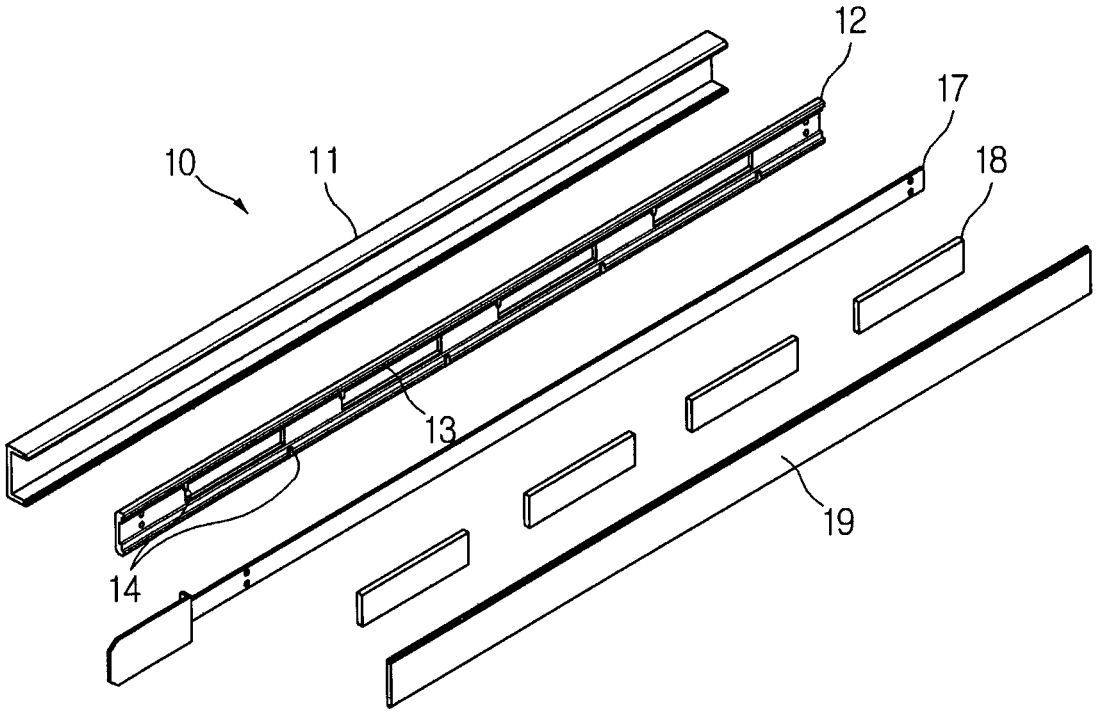
FIG. 2 is a schematic exploded perspective view illustrating the shape of an exemplary PTC rod assembly.
Figure 3:
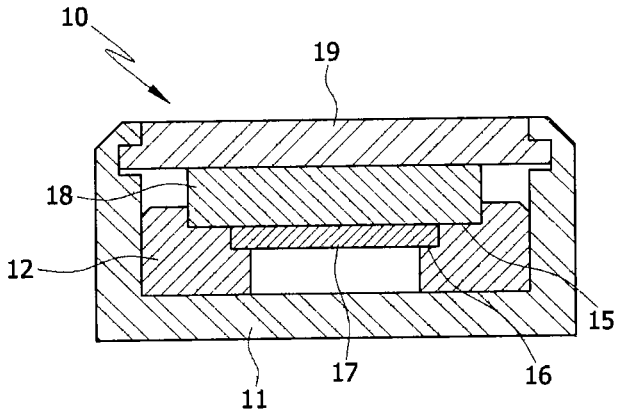
FIG. 3 is a cross-sectional view illustrating an exemplary PTC rod assembly.
Figure 4:
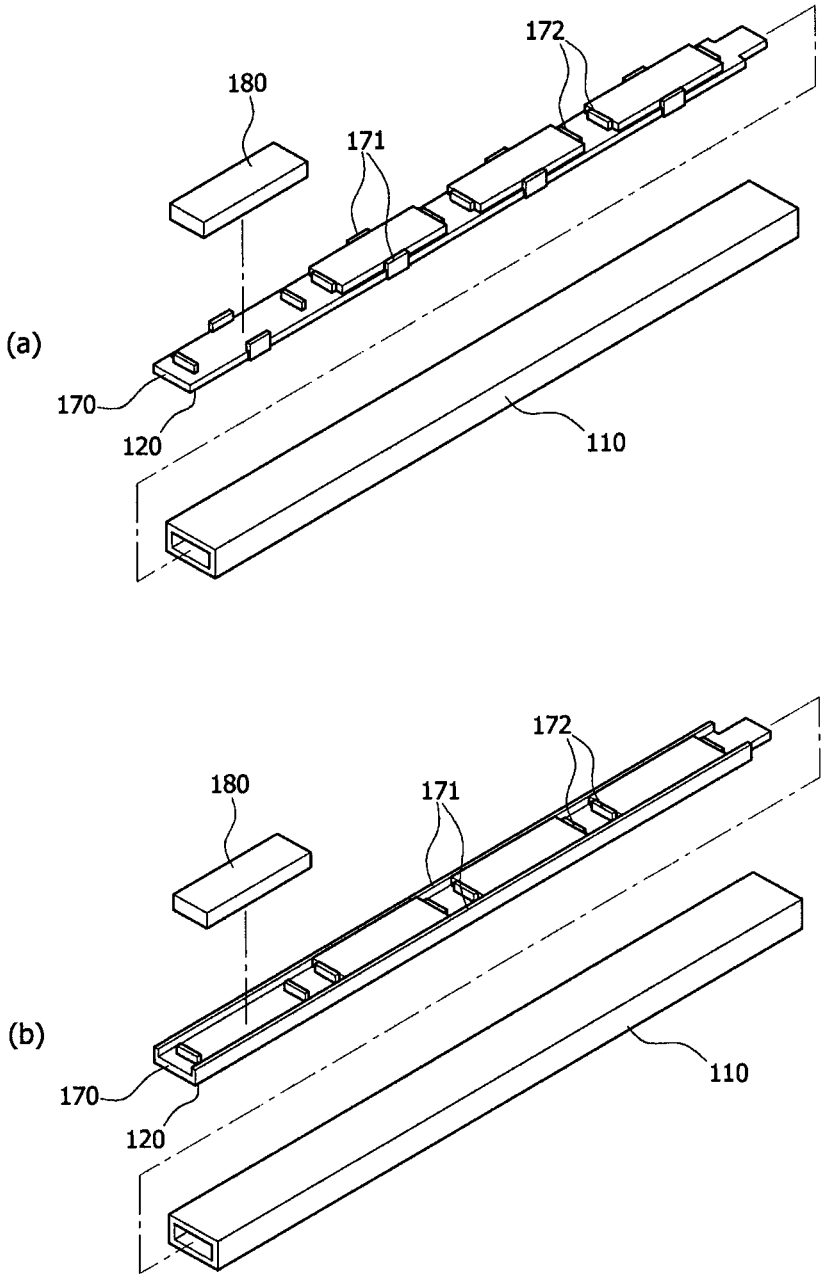
FIGS. 4A and 4B are schematic exploded perspective views illustrating the construction of PCT rod assemblies according to exemplary embodiments of the invention.

FIGS. 4A and 4B are schematic exploded perspective views illustrating the construction of a Positive Temperature Coefficient (PTC) rod assembly according to exemplary embodiments of the invention, and FIGS. 5A and 5B are cross-sectional views illustrating the internal construction of PTC rod assemblies according to exemplary embodiments of the invention.

As shown in FIGS. 4A, 4B, 5A and 5B, each of PTC rod assemblies according to exemplary embodiments of the invention includes PTC elements 180 generating heat when electric power is supplied thereto, an electrode terminal 170 in contact with the PTC elements 180 to supply electric power to the PTC elements 180 to generate heat, an insulating member 120 attached to a predetermined area of the electrode terminal 170 to electrically insulate the predetermined area of the electrode terminal 170, and a rod cover 110 housing therein the PTC elements 180, the electrode terminal 170 and the insulating member 120.

As shown in FIGS. 4A, 4B, 5A and 5B, the electrode terminal 170 is in the form of a flat plate with the upper surface thereof contacting the lower surface of the PTC elements 180. The electrode terminal 170 has protrusions 171 formed on opposite longitudinal edges thereof to contact longitudinal edges of the PTC elements 180, thereby holding the PTC elements 180 between the protrusions 171. Here, the insulating member 120 is attached to the lower surface of the electrode terminal 170 and outer surfaces of the protrusions 171, which are not in contact with the PTC elements 180.

The PTC elements 180, the electrode terminal 170 and the insulating member 120 assembled as described above are housed inside the rod cover 110 such that the upper surface of the PTC elements 180 and the outer surfaces of the insulating member 120 are fixed to and contacted with the inner surfaces of the rod cover 110.

With this configuration, as shown in FIGS. 5A and 5B, the electrode terminal 170 is electrically insulated by the insulating member 120 and thus is not in direct contact with the rod cover 110. The PTC elements 180 are in contact with the inner surface of the rod cover 110, and current supplied from the electrode terminal 170 flows to the PTC elements 180. Specifically, the current supplied to the electrode terminal 170 from an external power source (not shown) flows to the rod cover 110 through the PTC elements 180, which are in contact with the electrode terminals 170. When electric power is supplied through this process, the PTC elements 180 generate heat.

Therefore, the PTC rod assembly according to exemplary embodiments of the invention does not use an additional insulator of the related art, which supports the PTC elements 180 thereon while electrically insulating the electrode terminal 170 from the rod cover 110. Specifically, in the PTC rod assembly according to exemplary embodiments of the invention, the PTC elements 180 are held in the protrusions 171 of the electrode terminal 170 and are in contact with the electrode terminal 170, and the electrode terminal 170 is electrically insulated from the rod cover 110 by a simple structure of the insulating member 120, which prevents the outer surfaces of the electrode terminal 170 from coming into contact with the inner surfaces of the rod cover 110.

According to the construction as described above, the PTC rod assembly according to exemplary embodiments of the invention can be easily fabricated due to a simple structure, is inexpensive to fabricate due to a reduced number of parts, and has improved heat transfer efficiency since the PTC rod assembly has a minimized hollow space inside the rod cover 110.

Figure 5:
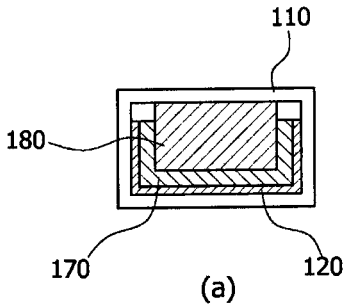
FIGS. 5A and 5B are cross-sectional views illustrating the internal construction of PTC rod assemblies according to exemplary embodiments of the invention.
Figure 5:
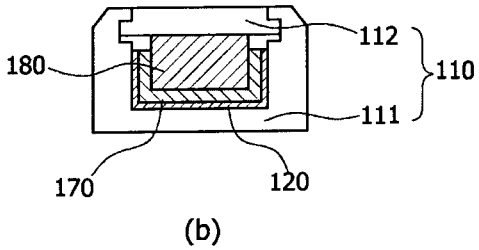

Describing in more detail, as shown in FIG. 5, the insulating member 120 is attached to the entire area of the lower surfaces of the electrode terminal 170 and the outer surfaces of the protrusions 171. Since the insulating member 120 is in close contact with the inner surface of the rod cover 110, the hollow space inside the rod cover 110 is minimized. Although not shown in the drawings, the insulating member 120 can also be attached to the upper surfaces of the protrusions 171 of the electrode terminal 170 and the height of the upper surface of the protrusions 171 can be set the same as that of the upper surface of the PTC elements 180, thereby housing the PTC elements 180 and the electrode terminal 170 inside the rod cover 110 without a hollow space.

Accordingly, heat generated from the PTC elements 180 is conducted to the rod cover 110 through the upper surface of the PTC elements 180, and at the same time, is conducted to the rod cover 110 through the lower surface of the PTC elements 180, the electrode terminal 170 and then the insulating member 120. As a result, the heat generated from the PTC elements 180 is conducted in both directions through the upper surface and through the lower surface, thereby further enhancing the heat transfer efficiency of the PTC rod assembly constructed as above.

According to the above-described heat transfer structure, in various embodiments of the invention, the insulating member 120 can be made of a material having good thermal conductivity. In various embodiments of the invention, the insulating member 120 can be an insulating coating layer, which is formed on the insulating surface thereof by anodizing. As an alternative, the insulating member 120 can be an insulating film bonded to the insulating surface of the electrode terminal 170.

As shown in FIG. 4A, the protrusions 171 of the electrode terminal 170 can be formed on predetermined portions of the opposite longitudinal edges of the electrode terminal 170 to be located on the central portions of longitudinal edges of the PTC elements 180 in order to fixedly hold and contact the PTC elements 180. Alternatively, as shown in FIG. 4B, the protrusions 171 of the electrode terminal 170 can be formed in entire portions of the opposite longitudinal edges of the electrode terminal 170.

In various embodiments, including that shown in FIGS. 4A and 4B, the electrode terminal 170 can be provided with additional fixing portions 172 for enhancing a fixing force on the PTC elements 180. The fixing portions 172 can protrude from one side of the electrode terminal 170 to be located on the central portions of opposite ends of the PTC elements 180. With this configuration, the PTC elements 180 can be fixedly held so as not to move in the longitudinal direction of the electrode terminal 170 and be in more close contact with the electrode terminal 170. The fixing portions 172 can be formed integrally with the electrode terminal 170, or be attached to one side of the electrode terminal 170.

As shown in FIG. 5A, the rod cover 110 can be in the form of an integral pipe that is formed by extrusion to house therein the PTC elements 180, the electrode terminal 170 and the insulating member 120. Alternatively, as shown in FIG. 5B, the rod cover 110 can be divided into a lower rod cover 111 and an upper rod cover 112. The lower rod cover 111 has a U-shaped cross section to house and surround the PTC elements 180, the electrode terminal 170 and the insulating member 120, and the upper rod cover 112 is coupled to an open upper portion of the lower rod cover 111.

For convenience in explanation and accurate definition in the appended claims, the terms "upper" or "lower", "inside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A positive temperature coefficient rod assembly, comprising:

a positive temperature coefficient element generating heat when electric power is supplied thereto;

an electrode terminal configured as a flat plate with at an upper surface thereof contacting a lower surface of the positive temperature coefficient element, wherein the electrode terminal has protrusions extending upwardly from the flat plate at opposite longitudinally-extending edges thereof to directly contact opposite lateral sides of the positive temperature coefficient element to supply electricity to the positive temperature coefficient element and to hold the positive temperature coefficient element between the protrusions;

an insulating member attached to a lower surface of the electrode terminal and outer surfaces of the protrusions that are not in contact with the positive temperature coefficient element; and a rod cover housing therein the positive temperature coefficient element, electrode terminal and insulating member;

wherein an upper surface of the positive temperature coefficient element and outer surfaces of the insulating member are fixedly contacting the inner surfaces of the rod cover; and wherein the insulating member comprises an insulating film bonded to the lower surface of the electrode terminal and the outer surfaces of the protrusions.

2. The positive temperature coefficient rod assembly according to claim 1, wherein the protrusions of the electrode terminal are formed on predetermined portions of the opposite longitudinal edges of the electrode terminal to be located on central portions of longitudinal edges of the positive temperature coefficient element.

3. The positive temperature coefficient rod assembly according to claim 1, wherein the protrusions of the electrode terminal are formed on entire areas of the opposite longitudinal edges of the electrode terminal.

4. The positive temperature coefficient rod assembly according to claim 1, wherein the rod cover comprises an integral pipe that is formed by extrusion to house therein the positive temperature coefficient element, the electrode terminal and the insulating member.

5. The positive temperature coefficient rod assembly according to claim 1, wherein the rod cover includes:

a lower rod cover having a U-shaped cross section, wherein the lower rod cover houses and surrounds the positive temperature coefficient element, the electrode terminal and the insulating member; and an upper rod cover coupled to an open upper portion of the lower rod cover.

6. The positive temperature coefficient heater assembly including a rod assembly according to claim 1, heat-radiating fin assemblies disposed in parallel on opposite sides of the rod assembly, a cathode terminal disposed between the heat-radiating fin assemblies, and a pair of housings disposed at opposite ends of the rod assembly.

* * * * *